US006864866B2

(12) United States Patent
Aoki

(10) Patent No.: US 6,864,866 B2
(45) Date of Patent: Mar. 8, 2005

(54) LIQUID CRYSTAL DISPLAY DEVICE, IMAGE SIGNAL CORRECTION CIRCUIT, IMAGE SIGNAL CORRECTION METHOD, AND ELECTRONIC DEVICES

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 367 days.

(21) Appl. No.: 09/994,697

(22) Filed: Nov. 28, 2001

(65) Prior Publication Data

US 2002/0067324 A1 Jun. 6, 2002

(30) Foreign Application Priority Data

Dec. 1, 2000 (JP) ..... 2000-366966
Oct. 30, 2001 (JP) ..... 2001-332922

(51) Int. Cl.[7] ..... G09G 3/20
(52) U.S. Cl. ..... 345/58; 345/87
(58) Field of Search ..... 345/87, 89, 94, 345/96, 88, 50, 51, 54, 58, 214; 349/33, 41, 42

(56) References Cited

U.S. PATENT DOCUMENTS 5,434,588 A * 7/1995 Parker ..... 345/98
5,640,173 A * 6/1997 Prince et al. ..... 345/58
5,798,740 A * 8/1998 Bitzakidis et al. ..... 345/92

FOREIGN PATENT DOCUMENTS

| | | | |
|---|---|---|---|
| JP | H02-187788 | A | 7/1990 |
| JP | H02-187789 | A | 7/1990 |
| JP | H04-011281 | A | 1/1992 |
| JP | H09-508222 | A | 8/1997 |
| JP | 10-153759 | A | 6/1998 |
| JP | 2000-330093 | A | 11/2000 |

* cited by examiner

*Primary Examiner*—Chanh Nguyen
(74) *Attorney, Agent, or Firm*—Oliff & Berridge, PLC

(57) ABSTRACT

A liquid crystal display device of the present invention includes a subtracter that calculates the difference between an image signal and a reference signal. The image signal has information corresponding to the density of a pixel arranged in a matrix extending in row and column directions and being supplied in synchronization with horizontal scanning in the row direction and vertical scanning in the column direction. The reference signal has information corresponding to a reference density. The liquid crystal display device also includes a first accumulator group and a second accumulator group that accumulate the difference for each column for one vertical scanning period; and an adder that adds a value corresponding to an accumulated value associated with a column to the image signal, DV, of the column for correction. With this arrangement, the deterioration of display quality caused by vertical cross-talk is reduced, minimized or resolved by correcting the image signal.

9 Claims, 10 Drawing Sheets

LIQUID CRYSTAL DISPLAY DEVICE, IMAGE SIGNAL CORRECTION CIRCUIT, IMAGE SIGNAL CORRECTION METHOD, AND ELECTRONIC DEVICES

BACKGROUND OF THE INVENTION

1. Field of Invention

The present invention relates to a liquid crystal display device, an image signal correction circuit, an image signal correction method, and electronic devices designed to reduce, minimize or prevent deterioration of display quality caused by vertical cross-talk without using pre-charging.

2. Description of Related Art

In general, a liquid crystal panel is arranged to have liquid crystal sandwiched between a pair of substrates. These liquid crystal panels can be classified into various types, depending on the driving method. For example, an active-matrix-type panel, in which pixel electrodes are driven by three-terminal-type switching elements, is arranged as shown in FIG. 9.

Specifically, a liquid crystal panel of this type is arranged such that a plurality of scanning lines 112 extending in the row (X) direction, and a plurality of data lines 114 extending in the column (Y) direction, cross each other, and a pixel formed of a pair of a thin film transistor (hereinafter referred to as "TFT") 116, which is an example of a three-terminal switching element, and a liquid crystal capacitor 105, is disposed corresponding to each of the intersections. Here, the liquid crystal capacitor 105 is formed by sandwiching liquid crystal between a rectangular pixel electrode and a counter electrode. In this regard, for the convenience of explanation, pixels are assumed to be arranged in a matrix state with m rows and n columns (wherein m and n are both integers).

Further, a peripheral circuit 120 is disposed so as to surround the area in which these pixels are disposed (display area). In detail, the peripheral circuit 120 includes a scanning line driving circuit 130, which turns scanning signals G1, G2, G3, . . . , Gm, supplied to each of the scanning lines 112, to an active level (H level) exclusively in sequence for each single horizontal scanning period, a data line driving circuit 140, which outputs sampling signals S1, S2, S3, . . . , Sn becoming an active level exclusively in sequence within each single horizontal scanning period, and a sampling circuit 150 formed of switches 151 for each data line 114. Among these elements, each of the switches 151 of the sampling circuit 150 turn on when the corresponding signals of the sampling control signals S1, S2, S3, . . . , Sn reach the active level, and samples an image signal VID supplied to an image signal line 171 to be supplied to the data lines 114.

Here, TFT 116, which is arranged at the intersection of a scanning line 112 and a data line 114, turns on when the scanning signal applied to the corresponding scanning line reaches the active level, and supplies the image signal VID, which is sampled on the corresponding data line, to the pixel electrode. At the same time, the counter electrode, corresponding to the pixel electrode, is shared with each liquid crystal capacitor 105, and maintained at a constant voltage over time. Thus, the voltage difference of the voltage of the counter electrode and the voltage of the image signal is applied across the liquid crystal capacitor 105. Subsequently, when TFT 116 turns off, the voltage applied to the liquid crystal capacitor is maintained by itself and the storage capacitor 119 connected in parallel.

At the same time, on each opposing face of both substrates, an orientation film that is processed by rubbing is disposed in such a manner that the longitudinal directions of molecules are twisted by about 90 degrees between both of the substrates, whereas a light polarizer, which depends on each orientation direction, is disposed on each back side of both substrates.

At this time, the light passing through the liquid crystal capacitor 105 optically rotates about 90 degrees along with the twisting of the liquid crystal molecules when the voltage applied to the capacitor is zero, whereas the higher the voltage becomes, the greater the molecules lean to the orientation of the electric field, thereby losing optical rotating power. Accordingly, for example, in the transmissive type, in the case where polarizers, having their polarizing axes orthogonal to each other in accordance with the orientation, are disposed on the incident side and rear side (in the case of normally white mode), if the voltage difference applied to both of the electrodes is zero, the light transmits to become a white display (transmittance ratio becomes high), whereas the greater the voltage difference applied to both of the electrodes, the stronger the light is dimmed, and finally becomes a black display (transmittance ratio becomes low). Consequently, by controlling the effective voltage applied to the liquid crystal capacitor 105 for each pixel, it is possible to display a predetermined gray level.

SUMMARY OF THE INVENTION

However, a problem arises that deterioration of display quality occurs by vertical cross-talk in such a liquid crystal panel. Here, the terms vertical cross-talk means that, in the case of a normally white mode, for example, as shown in FIG. 10, when showing a rectangular black area in a window with a gray background, the pixels in a gray area located above and below (in the direction of vertical scanning) the black area become darker than the original gray color. In this regard, in FIG. 10, density is shown by the line density of slanted lines.

Various studies have been performed with regard to the cause of the vertical cross-talk, and the leakage of light from TFT 116 which switches the liquid crystal capacitor 105 is considered as a major cause. Specifically, the charge stored in the liquid crystal capacitor 105 by turning TFT 116 on should be originally maintained by turning TFT 116 off. However, it is considered that carriers occur in TFT 116 by intrusion light, and thus the charge leaks, thereby being affected by the voltage of the data line 114, which results in fluctuation of the stored charge in the liquid crystal capacitor 105. Particularly, in a projector which performs extended projection of the image of a liquid crystal panel, it is considered that the liquid crystal panel is exposed to a very strong light, and thus deterioration of display quality due to leakage of light is distinctly observed.

In order to prevent vertical cross-talk such as that discussed above, the technology, in which pre-charging the voltage corresponding to the black color, is effective before sampling the image signal, VID, to the data line 114. Pre-charging like this is performed by the pre-charging circuit 160 in the structure as shown in FIG. 9. In detail, first, in the horizontal blanking period, the switch 161 disposed for each data line 114 turns on according to a pre-charge control signal, PG, and, second, the voltage of the pre-charge signal, PS, at the time of turning on is set to the voltage corresponding to the black color of the image signal, VID, which is sampled during the horizontal valid display period and afterwards.

However, if the data line 114 is pre-charged to the voltage corresponding to the black color, the data line 114 is sampled to the voltage corresponding to the original density thereafter, and since the sampled voltage is written to the liquid crystal capacitor 105, the leaking amount of the entire liquid crystal panel increases all the more, which is not preferable. Also, depending on the extent of vertical cross-talk, vertical cross-talk might not be resolved by only using the pre-charging technology.

Precisely, since pre-charging is performed to all the data lines 114 all at once in the horizontal blanking period, the retaining period of the pre-charging signal, PS, on the data line 114 varies a lot for each data line 114. For example, in FIG. 9, the data line 114 that is located at the left end is sampled with the original image signal, VID, immediately when the sampling control signal S1 reaches an H level after the pre-charging, whereas the data line 114 located at the right end is sampled with the original image signal, VID, when the sampling control signal Sn reaches an H level after the sampling control signals S1, S2, S3, . . . , reach an H level in sequence after pre-charging. Thus, the effect of the pre-charging is quite different between the right and left of the display area.

Consequently, it is considered preferable to preventing deterioration of display quality caused by vertical cross-talk by a technology other than pre-charging.

Accordingly, the present invention is made in view of the foregoing, and an object is to provide a liquid crystal display device, an image signal correction circuit, an image signal correction method, and electronic devices which are capable of a high quality display by reducing, minimizing or preventing vertical cross-talk without using pre-charging.

In order to achieve the above-described object, an image signal correction method according to a first aspect of the present invention corrects an image signal which has information corresponding to the density of a pixel arranged in a matrix extended in the row direction and the column direction, and being supplied in synchronization with horizontal scanning in the row direction and vertical scanning in the column direction. The correction method includes:

calculating the difference between the image signal and a reference signal having information corresponding to a reference density;

calculating an accumulated value of the difference for each column for one vertical scanning period; and adding a value corresponding to the accumulated value to the image signal of the pixel of the column corresponding to the accumulated value for correction.

With this method, the difference between the image signal and the reference signal is accumulated for each column, and the resultant value is added to the image signal of the column as a correction value. By this method, the image signal corresponding to a certain pixel is corrected reflecting the density (difference from the reference density) of all the pixels located in the same column as the pixel, that is, in consideration of the voltage fluctuation of the common data line during the horizontal valid display period. Thus, for example, in FIG. 10, the image signal of the gray pixels in the column where no black area exists is not corrected very much, whereas the image signal of the gray pixels in the column where black area exists is corrected corresponding to both the difference between the density of the black color and the density specified by the reference signal, and the distance of the black area in the vertical direction, h. Consequently, when the image signal of the gray pixels in the column where black area exists in the Y-direction is corrected considering the black display area, the influence of the vertical cross-talk is removed, and as a result, the display density based on the corrected image signal is close to the density corresponding to the image signal before correction, thereby reducing, minimizing or preventing deterioration of display quality.

Also, in order to achieve the above-described object, an image signal correction circuit according to a second aspect of the present invention corrects an image signal which has information corresponding to the density of a pixel arranged in a matrix extended in the row direction and the column direction, and is supplied in synchronization with horizontal scanning in the row direction and vertical scanning in the column direction. The correction circuit includes:

a subtracter which calculates the difference between the image signal and a reference signal having information corresponding to a reference density;

an accumulator which accumulates the value of the difference for each column for one vertical scanning period; and an adder which adds a value corresponding to the accumulated value calculated by the accumulator to the image signal of the pixel of the column corresponding to the accumulated value for correction.

With this arrangement, in the same manner as the first aspect of the present invention, the image signal corresponding to a certain pixel is corrected reflecting the density (difference from the reference density) of all the pixels located in the same column as the pixel, and thus the influence of the vertical cross-talk is removed, and as a result, the display density based on the corrected image signal is close to the density corresponding to the image signal before correction, thereby reducing, minimizing or preventing deterioration of display quality.

Here, in the second aspect of the present invention, it is preferable that the accumulator includes:

an accumulator selection part which is provided corresponding to pixels of two rows and selects, from the accumulators corresponding to one of the rows, an accumulator in the column of the pixel specified by the image signal, and accumulates the difference, and which selects, from the accumulators corresponding to the other row, an accumulator in the column of the pixel specified by the image signal, and reads the accumulated value; and a switching part which switches the accumulators belonging to one row and the accumulators belonging to the other row for every single vertical scanning period. With this arrangement, for an image signal of a certain vertical scanning period, as compared with the arrangement in which an image signal is corrected based on the image signals of the same column during the vertical scanning period, less memory capacity is necessary for the accumulator, thereby making it possible to simplify the structure.

Also, in the second aspect of the present invention, it is preferable that the reference signal has information corresponding to a gray density, particularly, a gray area in the black side. This is preferable because, in general, when considering the characteristic of the voltage effective value applied to the liquid crystal capacitor and the transmittance ratio (V-T characteristic), in the area where the transmittance ratio is intermediate (area where pixels are gray, which is in the middle of black and white), only a small amount of voltage change causes a large amount of density change, and thus it is effective to compare with the reference signal which has information corresponding to gray density.

Moreover, the image signal for one vertical scanning period, which is accumulated in the accumulator, is the image signal immediately before the one vertical scanning period with reference to the image signal of the one vertical scanning period to be corrected.

Also, the difference by the subtracter or the value corresponding to the accumulated value is multiplied by a coefficient.

Furthermore, the coefficient may have a different value in the case of a positive-polarity writing and in the case of a negative-polarity writing.

Similarly, in order to achieve the above-described object, a liquid crystal display device according to a third aspect of the present invention includes:

a subtracter which calculates the difference between the image signal having information corresponding to the density of a pixel arranged in a matrix extended in the row direction and column direction and is supplied in synchronization with horizontal scanning in the row direction and vertical scanning in the column direction, and the reference signal having information corresponding to a reference density;

an accumulator which accumulates the value of the difference for each column for one vertical scanning period;

an adder which adds a value corresponding to the accumulated value to the image signal of the pixel of the column corresponding to the accumulated value; and a liquid crystal capacitor to which the voltage signal based on the signal output from the adder is applied corresponding to the horizontal scanning and vertical scanning. With this arrangement, in the same manner as the first and second aspects of the present invention, the image signal corresponding to a certain pixel is corrected reflecting the density (difference from the reference density) of all the pixels located in the same column as the pixel, and thus the influence of the vertical cross-talk is reduced, minimized or removed, as a result, the display density based on the corrected image signal is close to the density corresponding to the image signal before correction, thereby reducing, minimizing or preventing deterioration of display quality.

Furthermore, an electronic device according to the present invention incorporates the above-described liquid crystal display device as a display part, thereby making it possible to perform high quality display in which the influence of the vertical cross-talk is reduced, minimized or removed.

DETAILED DESCRIPTION OF PREFERRED EMBODIMENTS

In the following, an embodiment of the present invention will be described with reference to the drawings.

<1: Embodiment>

Figure 1:
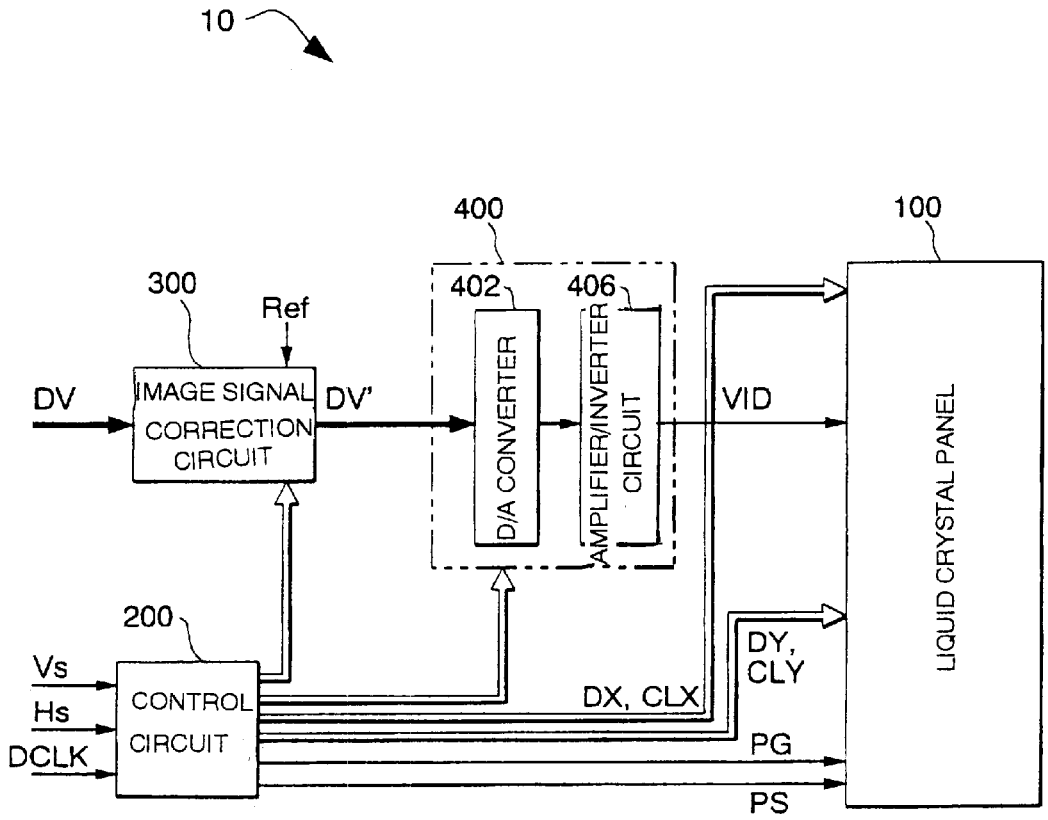
FIG. 1 is a block diagram showing the structure of the liquid crystal display device according to an embodiment of the present invention.

First, the electrical structure of a liquid crystal display device according to an embodiment will be described. FIG. 1 is a block diagram showing the electrical structure of the liquid crystal display device.

Figure 9:
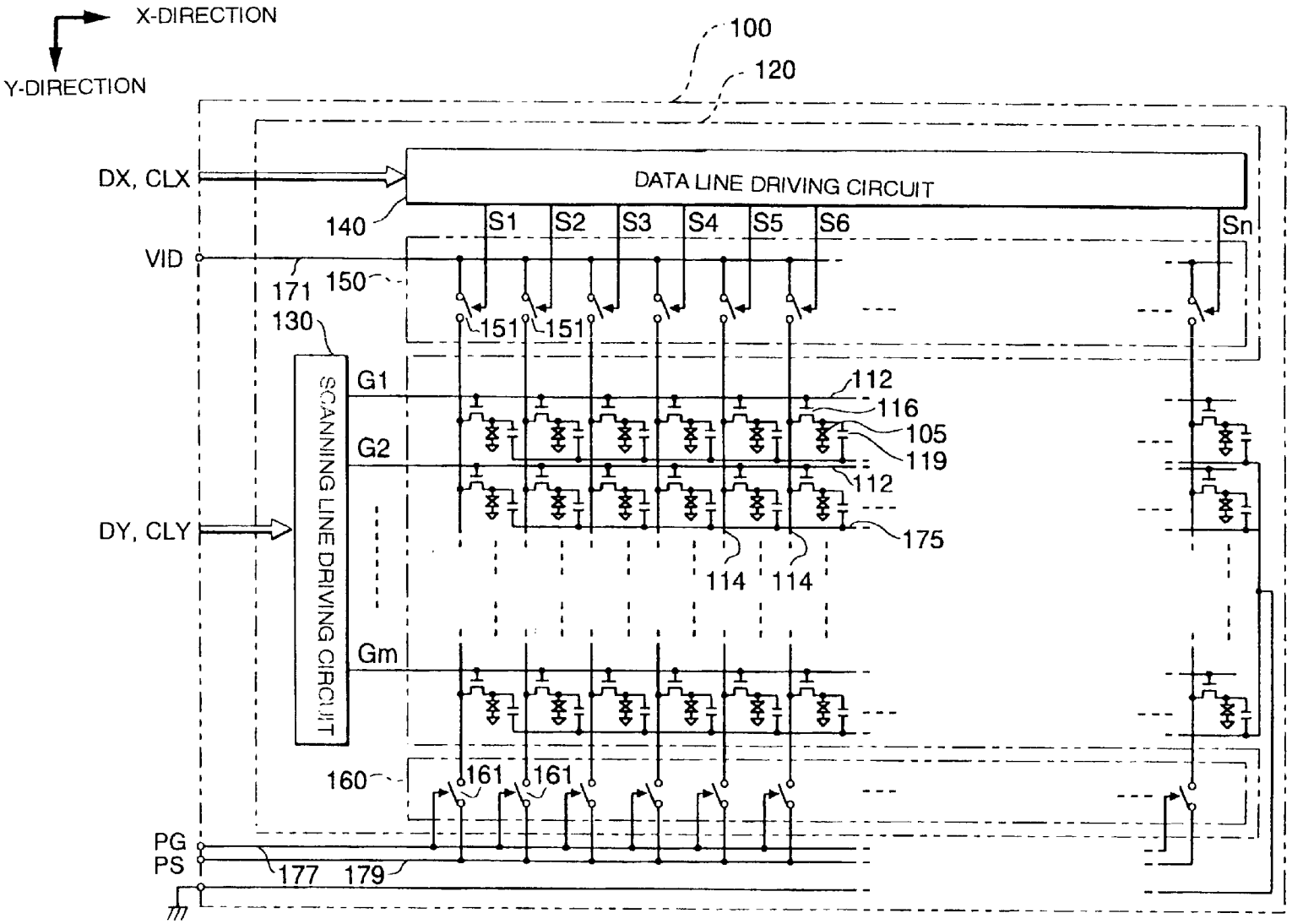
FIG. 9 is a circuit diagram showing the structure of the panel of the liquid crystal display device.

As shown in FIG. 1, the liquid crystal display device 10 includes a liquid crystal panel 100, a control circuit 200, an image signal correction circuit 300, and a processing circuit 400. Among these elements, the liquid crystal panel 100 has the same structure as the conventional structure shown in FIG. 9. Also, the control circuit 200 generates a timing signal and a clock signal that control each part following a vertical scanning signal Vs, a horizontal scanning signal Hs, and a dot clock signal DCLK which are supplied by an upper device.

Next, the image signal correction circuit 300 receives a digital image signal DV which is supplied in synchronization with the vertical scanning signal Vs, horizontal scanning signal Hs, and a dot clock signal DCLK (that is, following the vertical scanning and the horizontal scanning signal), and is corresponding to each pixel, and generates the correction signal, and then adds it to an original image signal DV to output a corrected image signal DV'. Specifically, details of the image signal correction circuit 300 will be described below.

Next, the processing circuit 400, which includes a D/A converter 402, and an amplifier/inverter circuit 406, processes the image signal DV' corrected by the image signal correction circuit 300 to output a signal adjusted that drives the liquid crystal panel 100. Among these elements, the D/A converter 402 converts the corrected digital image signal DV' to an analog image signal. Also, the amplifier/inverter circuit 406 inverts the polarity of the analog-converted image signal alternately to a positive polarity and a negative polarity with reference to a predetermined voltage for each single horizontal scanning period, and extends the voltage swing.

Here, the reference voltage that inverts polarity is nearly equal to the voltage of the counter electrode. Also, the determination as to whether or not to invert polarity is performed depending on the data-signal applying method, such as: A: polarity inversion for each scanning line, B: polarity inversion for each data signal line, or C: polarity inversion for each pixel, and the inversion cycle is set to one horizontal scanning period or dot-clock cycle. In this embodiment, for the convenience of explanation, a description is provided by an example in the case of A: polarity inversion for each scanning line. However, the present invention is not limited to this method, and other methods could also be used.

In this regard, here, it is arranged that the input signal to the processing circuit 400 is analog-converted, but it can, of course, be arranged that the digital signal is polarity-inverted, and then analog-converted.

Also, regarding the image signal DV, DV', and VID, when indicating these signals in connection with the coordinates of a pixel, they are denoted by DV (i, j), DV' (i, j), and VID (i, j), respectively. Here, in the present embodiment, given that the pixels are arranged in a matrix having m rows and n columns (both m and n are integers), i is an integer satisfying $1 \leqq i \leqq m$, and j is an integer satisfying $1 \leqq j \leqq n$. Specifically, i and j represent a row coordinate of the pixel and a column coordinate of the pixel, respectively.

<1-1: Details of Image Signal Correction Circuit>

Figure 2:
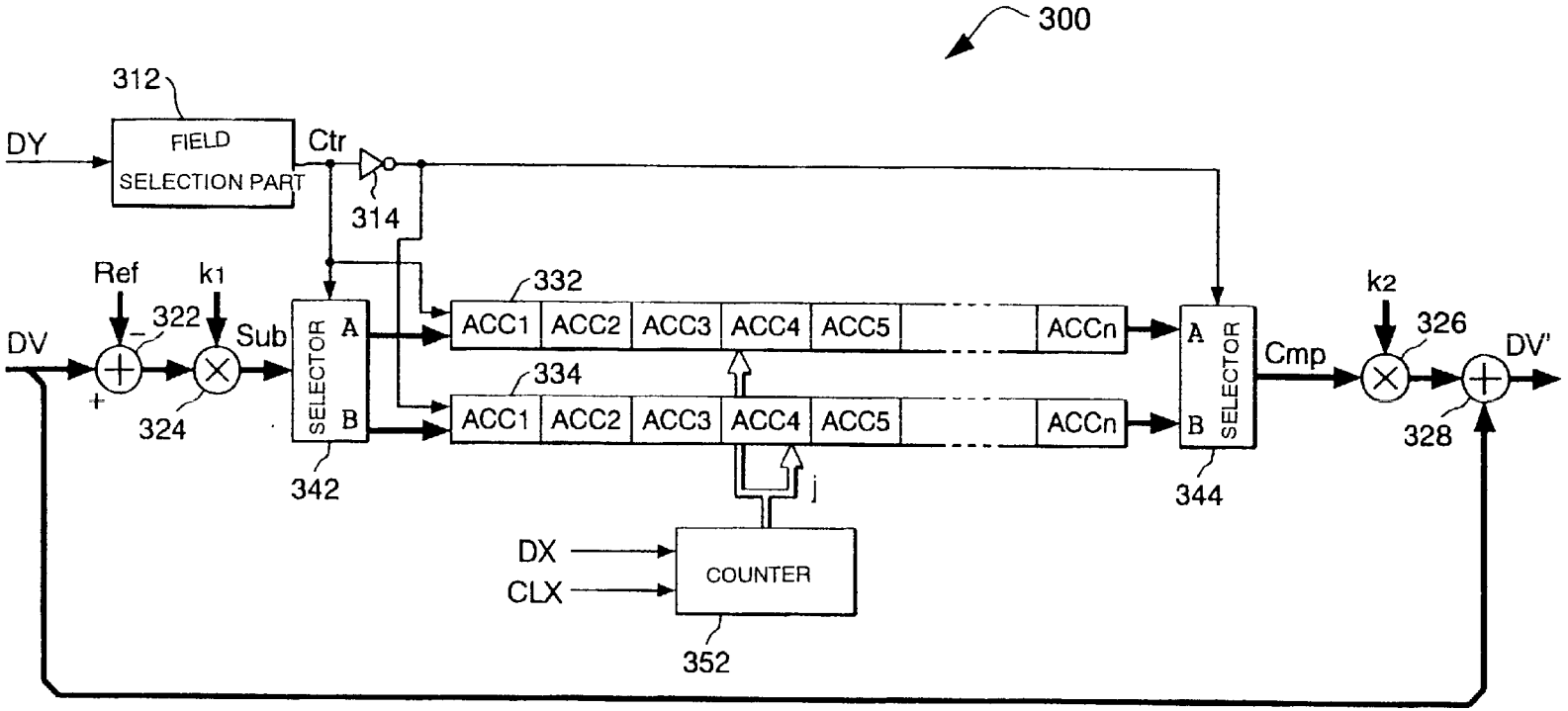
FIG. 2 is a block diagram showing the structure of the image signal correction circuit of the liquid crystal display device.

Next, the details of the image signal correction circuit 300 will be described. FIG. 2 is a block diagram showing the structure of the image signal correction circuit 300.

Figure 3:
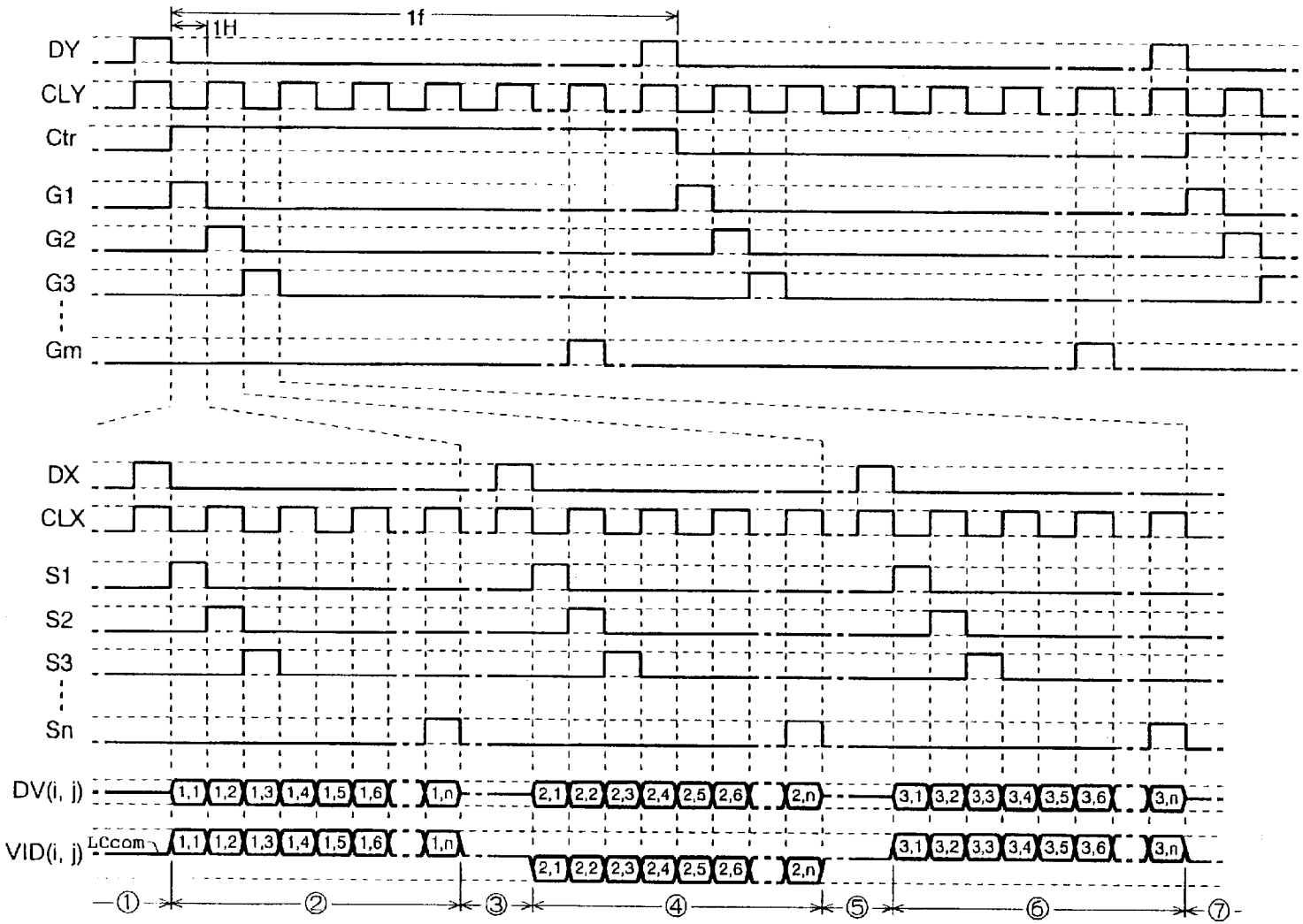
FIG. 3 is a timing chart that illustrates the image signal supplied to the liquid crystal display device.

A field selection part 312 shown in FIG. 2 inverts the logic level of the output signal Ctr by every input of the transfer start pulse DY. Here, the transfer start pulse DY is supplied from the control circuit (refer to FIG. 1), and as shown in FIG. 3, is supplied at the beginning of one vertical scanning period (one field) 1*f*. Consequently, as shown in FIG. 3, the logic level of the signal Ctr is inverted for every single vertical scanning period 1*f*.

At the same time, a subtracter 322 subtracts the reference signal Ref from the image signal DV which is supplied from the upper device in synchronization with vertical scanning and horizontal scanning, and has information corresponding to the density of a pixel. Here, the reference signal Ref can have information of a constant density, and in the present invention, the signal has information corresponding to gray, which is easy to visualize in terms of the deterioration of display quality, particularly, close to black. Next, a multiplier 324 multiplies the subtraction result of the subtracter 322 by an adjusting factor k1 to output the resultant value Sub.

Next, a selector 342 selects an output terminal A in a first case where the signal Ctr of a field selection part 312 is an H level, whereas the selector 342 selects an output terminal B in a second case where the signal Ctr of the field selection part 312 is an L level, and outputs the value Sub to the selected output terminal.

At the same time, a counter 352, as an accumulator selection part, has a counter value j, which is reset by the transfer start pulse DX supplied at the beginning of one horizontal scanning period, and is incremented and output by a rise and a fall of the clock signal DCL synchronized with dot clock DCLK.

Next, a first accumulator group 332 includes accumulators in n columns, ACC1 to ACCn, and each of the accumulators, ACC1 to ACCn, store the sum of the input value and the stored value by replacing them with a new memory value.

Here, when the signal Ctr goes to an H level, the first accumulator group 332 resets all the memory values of the accumulators ACC1 to ACCn, and then, in the first case described above where the signal Ctr is an H level, the signal of the output terminal A selected by the selector 342 (multiplication result by the multiplier 324) is set to the input value of an accumulator corresponding to the count value j of the counter 352, whereas in the second case described above where the signal Ctr is an L level, the accumulated value of the accumulator corresponding to the counter value j is output.

Similarly, a second accumulator group 334 includes accumulators ACC1 to ACCn in n columns. Contrary to the first accumulator group 332, when the inverted signal of the signal Ctr by an inverter 314 goes to an H level (the signal Ctr goes to an L level), the second accumulator group 334 resets the memory values all the accumulators ACC1 to ACCn, and then, the signal of the output terminal B selected by the selector 342 (multiplication result by the multiplier 324) in the second case described above where the reverse signal is an H level (the signal Ctr is an L level), the signal of the output terminal B selected by the selector 342 is set to the input value of an accumulator corresponding to the count value j, whereas in the first case described above where the reversed signal is an L level (the signal Ctr is an H level), the accumulated value of the accumulator corresponding to the counter value j is output.

Consequently, the input value selected by the selector 342 is supplied into an accumulator corresponding to the counter value j of the counter 352 in one of the first accumulator group 332 and the second accumulator group 334, and an accumulated value of the accumulator corresponding to the count value j in the other one of the first accumulator group 332 and the second accumulator group 334 is output.

Next, a selector 344 selects the input terminal B in a first case where the inverted signal of the signal Ctr by the inverter 314 is an L level, whereas the selector 344 selects the input terminal A in the case where the same inverted signal is an H level, and then outputs the value Cmp.

Next, a multiplier 326 multiplies the value Cmp by an adjusting factor k2. Furthermore, an adder 328 adds the multiplication result of the multiplier 326 as a correction value to an image signal DV (i, j) before adjustment, and output as an image signal DV' (i, j).

Specifically, in the first accumulator group 332, when the signal Ctr reaches the H level from the L level, the memory values of the accumulators are reset, and then while the H level is maintained, the multiplication result is input from the selector 342 to the accumulator, and when the signal Ctr is the L level, the accumulated value of the accumulator is output.

On the other hand, in the second accumulator group 334, when the signal Ctr reaches the L level from the H level, the memory values of the accumulators are reset, and then while the L level is maintained, the multiplication result is input from the selector 342 to the accumulator, and when the signal Ctr is the H level, the accumulated value of the accumulator is output.

Then, while the first accumulator group 332 is reset, or the multiplication result is input from the selector 342, the accumulated value of the second accumulator group 334 is calculated as a correction value via the selector 344, and the corrected image signal is generated.

On the other hand, while the second accumulator group 334 is reset, or the multiplication result is input from the selector 342, the accumulated value of the first accumulator group 332 is calculated as a correction value via the selector 344, and the corrected image signal is generated.

<2: Operation>

Next, the operations of the liquid crystal display device of the present embodiment will be described.

<2-1: Image Signal Supplying Timing>

Figure 4:
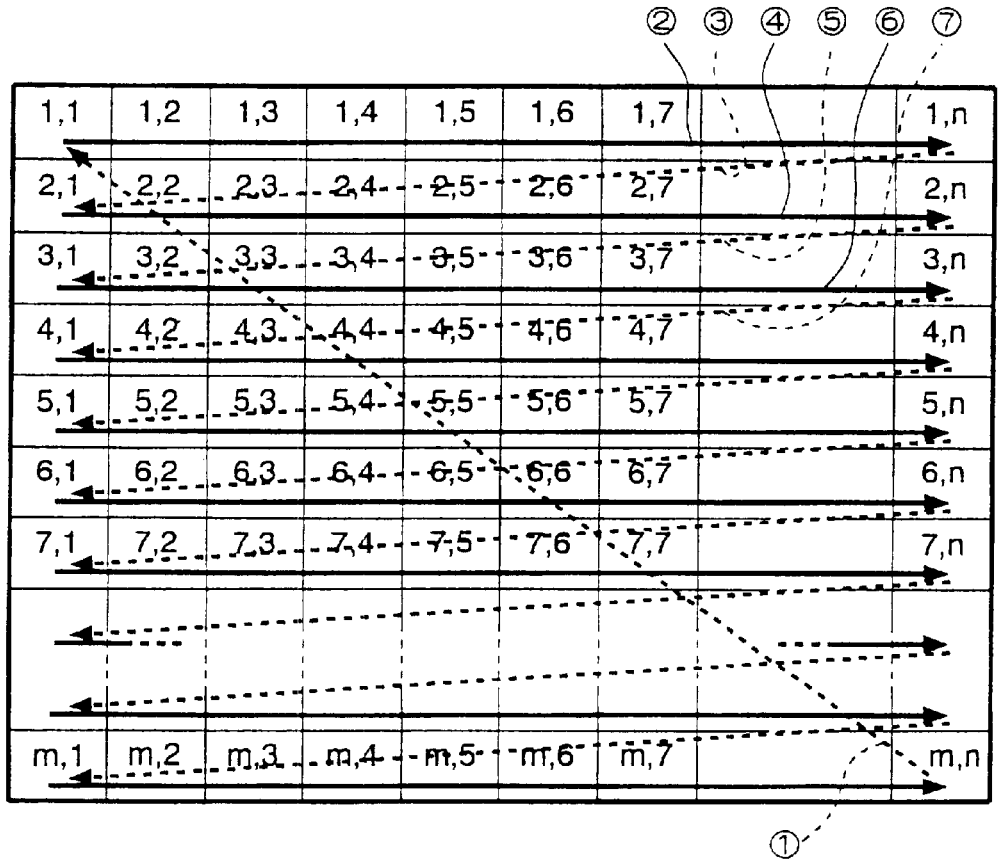
FIG. 4 is a chart showing the relationship between the image signal supplied to the liquid crystal display device and the pixel position of the panel, and illustrating the operation of the image signal correction circuit.

For the convenience of explanation, the relationship between various timing signals and an image signal DV (i, j) is explained. FIG. 3 is a timing chart illustrating the operation of the liquid crystal display device according to the present embodiment, and FIG. 4 is a chart showing the relationship between the pixel location of the liquid crystal display device and the image signal DV (i, j).

First, as shown in FIG. 3, when a transfer start pulse DY is supplied at the beginning of the vertical scanning period, the transfer start pulse DY is shifted in sequence by the scanning line driving circuit 130 (refer to FIG. 9) for each transition of the level of the clock signal CLY, and is output as scanning signals G1, G2, G3, . . . , Gm, each of which reaches an active level for each one horizontal scanning period, 1H, to the corresponding scanning line 112.

Among these, attention is now directed to one horizontal scanning period 1H, in which a scanning signal G1 reaches an active level. First, at the beginning of the horizontal valid display period, when the transfer start pulse DX is supplied as shown in FIG. 3, the transfer start pulse DX is shifted in sequence by the data line driving circuit 140 (refer to FIG. 9) for each transition of the level of the clock signal CLX, and is output as sampling control signals, S1, S2, S3, . . . , Sn.

In synchronization with the sampling control signals S1, S2, S3, . . . , Sn, image signals DV (1, 1), DV (1, 2), DV (1, 3), . . . , DV (1, n) are supplied.

Now, the image signal correction circuit 300 (refer to FIG. 1 and FIG. 2) adds the correction values (k2·Cmp), each of which corresponds to each column as described below to the supplied image signals DV (1, 1), DV (1, 2), DV (1, 3), . . . , DV (1, n), and outputs DV' (1, 1), DV' (1, 2), DV' (1, 3), . . . , DV' (1, n), and then these signals are converted to analog signals by D/A converter 402 (refer to FIG. 1), and further processed by the amplifier/inverter circuit 406. Given that, for the convenience of explanation, in the first horizontal scanning period, 1H, a positive-polarity writing is performed, the output image signals which are output from the amplifier/inverter circuit 406, VID (1, 1), VID (1, 2), VID (1, 3), . . . , VID (1, n) are almost at the high-level side with reference to the voltage of the counter electrode LCcom (strictly, the center of the voltage swing of the polarity inversion).

During the period in which a scanning signal G1 is an active level, when the sampling signal S1 becomes active, the image signal VID (1, 1) is sampled on the data line 114 of the first column. At this time, TFT 116 of the pixel located at the intersection of the scanning line 112 of the first row and the data line 114 of the first column turns on, and thus the image signal VID (1, 1) sampled is written into a liquid crystal capacitor 105 of the first row and the first column.

After this, when the sampling signal S1 reaches an active level, the image signal VID (1, 2) is sampled on the data line 114 of the second column, and is written into a liquid crystal capacitor 105 of the first row and the second column.

In the same manner as discussed above, when the sampling signals S3, S4, . . . , Sn become active levels in sequence, the image signals VID (1, 3), VID (1, 4), . . . , VID (1, n) are sampled in sequence, and are written into the liquid crystal capacitors 105 of the first row and the third column, the first row and the fourth column, . . . , and the first row and the nth column, respectively. In this way, during the horizontal valid display period (2) in which VID (1, 1), VID (1, 2), VID (1, 3), . . . , VID (1, n) are supplied, as shown in FIG. 4, writing into all the pixels in the first row is completed.

Next, a period in which a scanning signal G2 becomes active will be described. In the present embodiment, as described above, a polarity inversion is performed for each scanning line, and thus in this one horizontal scanning period, a negative-side writing is performed. Consequently, image signals VID (2, 1), VID (2, 2), . . . , VID (2, n), which are output from the amplifier/inverter circuit 406 in the horizontal valid display period (4) after the horizontal blanking period (3), are output at the nearly low-level side with reference to the voltage of the counter electrode LCcom. For other operations, they are the same as discussed above, and during the horizontal valid display period (4) in which S1, S2, S3, . . . , Sn become active, writing into all the pixels in the second row is completed.

In the same manner as discussed above, scanning signals G3, G4, . . . , Gn become active, and writings are performed into the pixels of the third row, fourth row, and the mth row. In this way, the positive-polarity writing is performed into the pixels having odd row numbers, whereas the negative-polarity writing is performed into the pixels having even row numbers, and thus writings into all the pixels of the first row to the mth row are completed in the vertical valid display period.

After this, when going through a vertical blanking period (1), in the next vertical valid display period, the same writings are also performed; however, the writing polarity into the pixel of each row is switched. Specifically, in the next vertical valid display period, the negative-polarity writing is performed into the pixels having odd row numbers, whereas the positive-polarity writing is performed into the pixels having even row numbers.

In this regard, in the vertical/horizontal blanking display periods, each of the data lines 114 is pre-charged to the voltage corresponding to black of pixels to be supplied immediately subsequently. However, in the present embodiment, an object is to reduce, minimize or resolve the deterioration of display quality caused by vertical cross-talk without pre-charging, and thus a description about pre-charging is omitted.

<2-2: Operation of Image Signal Correction Circuit>

Figure 5:
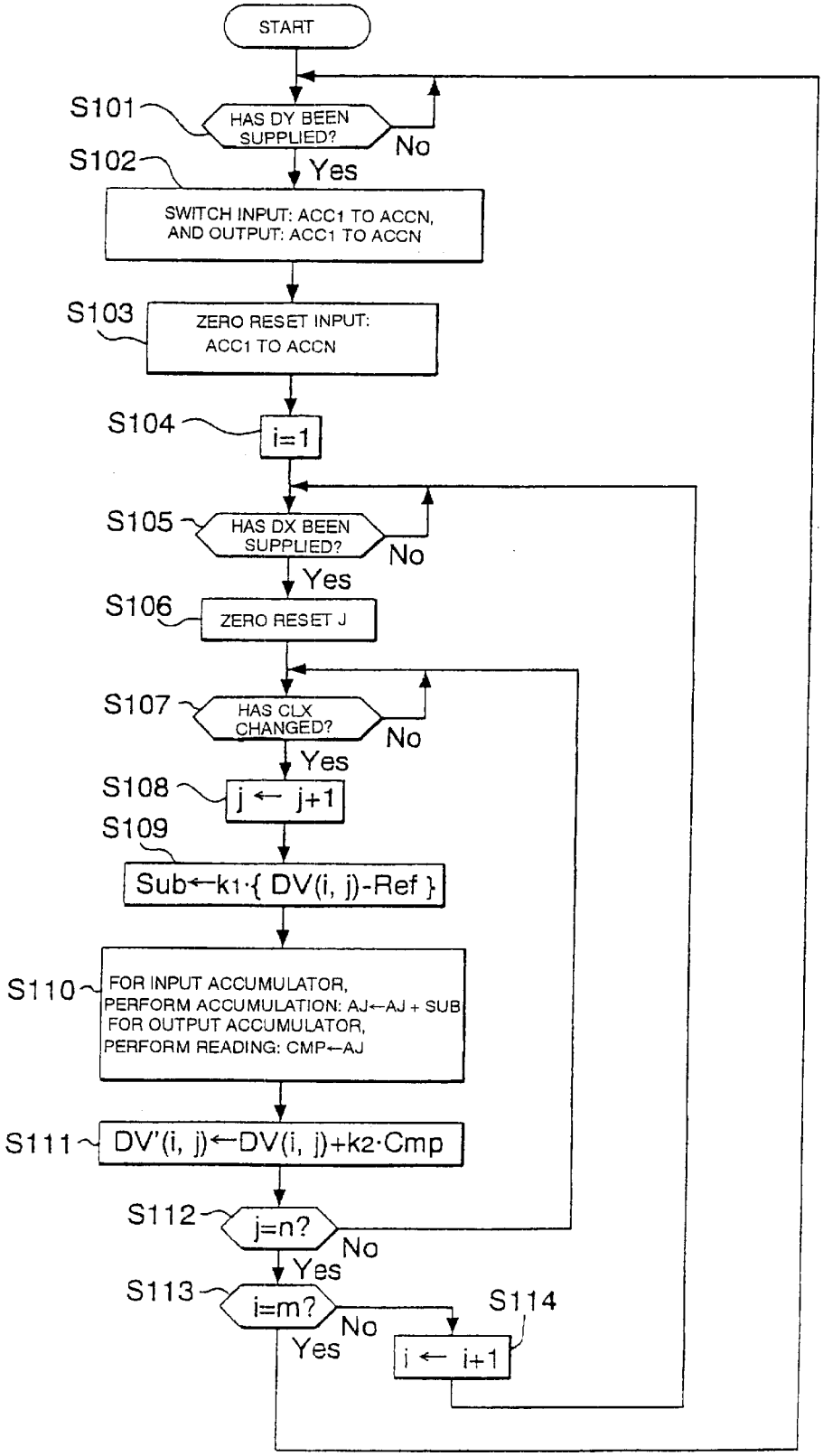
FIG. 5 is a flow chart that illustrates the operation of the image signal correction circuit of the liquid crystal display device.

Next, the operation of the image signal correction circuit 300 will be described with reference to FIG. 5 in addition to FIG. 2. FIG. 5 is a flowchart showing the operation of the image signal correction circuit 300.

First, the image signal correction circuit 300 enters a wait state until the transfer start pulse DY reaches an H level, that is, until becoming a vertical valid display period (Step S101). Here, when the transfer start pulse DY reaches an H level, the level of the signal Ctr is inverted by a field selection part 312.

By the inversion, the selector 342 selects the output terminal A, and thus a multiplication result of a multiplier 324 is supplied to the first accumulator group 324, whereas the selector 344 selects the input terminal B, and thus the accumulated values are read from the accumulators ACC1 to ACCn in the second accumulator group 334 (step S102). Also, when the signal Ctr reaches an H level, the accumulators ACC1 to ACCn in the first accumulator group are all reset (step S103). Next, i is set to "1" so as to correspond to the pixels of the first row to be processed (step S104).

After this, the image signal correction circuit 300 enters a wait state until the transfer start pulse DX reaches an H level, that is, until becoming a horizontal valid display period (Step S105). Here, when the transfer start pulse DX reaches an H level, the counter value j is zero reset by the counter 352 (step S107), and when the level of the clock signal CLX is changed, the counter value j is incremented by "1" (step S108).

Next, the difference when the reference signal Ref is subtracted from a currently-supplied image signal DV (i, j) through the subtracter 322 is then multiplied by the coefficient k1 through the multiplier 324, and the resultant product is provided as the value Sub (step S109).

Then, the value Sub is added to the previously stored value Aj in the accumulator ACCj corresponding to the current count value j among the accumulators ACC1 to ACCn in the accumulator group selected by the selector 342 according to the current signal Ctr, and set to a new stored value Aj. At the same time, a stored value Aj is read as the value Cmp from the accumulator ACCj corresponding to the current count value j among the accumulators ACC1 to ACCn in the accumulator group selected by the selector 344 according to the inverted signal of the current signal Ctr (step S110). Specifically, in the step S110, accumulation to the accumulator of the jth column in one of the accumulator groups, and reading from the accumulator of the jth column in the other one of the accumulator groups are concurrently performed.

Furthermore, the product when the read-out value Cmp is multiplied by the coefficient k2 through the multiplier 326 is added to the image signal DV (i, j), and the resultant sum is output as the corrected image signal DV' (i, j) (step S111).

Next, it is determined whether or not the current count value j is "n" which corresponds to the last column (step S112). If the result of the determination is negative, the processing is returned to the processing step S107 so as to perform the same operation again on the image signal of the pixel located at the next column in the same row. On the contrary, if the result of the determination in the step S112 is affirmative, it is determined whether or not the row of the pixel to be currently processed is "m" which corresponds to the last row (step S113).

If the result of the determination is negative, the processing is returned to the processing step S105 so as to perform the same operation again on the image signal of the pixel located in the next row. On the contrary, if the result of the determination in the step S113 is affirmative, the processing is returned to the step S101 so as to perform the same operation on the image signal of the pixel of the first row and the first column, which is the initial location, on the screen in the next vertical scanning.

Here, for the convenience of explanation, it is given that the signal Ctr reaches an H level when the transfer start pulse DY is supplied for the first time. In this case, the processing loop of the steps S107 to S113 is repeated while i=1, and j changes from 1 to n. As a result, each of the differences between the image signals, DV (1, 1), DV (1, 2), DV (1, 3), . . . , DV (1, n), corresponding to the pixels of the first row and the reference signal, Ref, is calculated and each of the differences is multiplied by the coefficient k1, that is the value Sub, and is stored in each of the accumulators ACC1, ACC2, ACC3, . . . , ACCn, respectively in the first accumulator group 332.

Next, when the counter value j becomes "n", the steps S113 and S114 are executed with the result that i=2, and furthermore, the counter j is zero reset in step S106, and then the loop processing of the steps 107 to 113 is executed repeatedly until j changes from 1 to n. As a result, each of the differences between the image signals, DV (2, 1), DV (2, 2), DV (2, 3), . . . , DV (2, n), corresponding to the pixels of the second row and the reference signal, Ref, is calculated and each of the differences is multiplied by the coefficient k1, that is the value Sub, and is accumulated in the stored value in each of the accumulators ACC1, ACC2, ACC3, . . . , ACCn, respectively in the first accumulator group 332.

Subsequently, when the same operation is executed repeatedly until i=m, each of the stored values in the accumulators ACC1, ACC2, ACC3, . . . , ACCn in the first accumulator group 332 is the accumulated value of the value Sub, which is the value that the difference between the image signal, DV, and the reference signal, Ref, is multiplied by the coefficient, k1, for each column, for the rows 1 to m (that is, for the period of single vertical scanning period).

In this regard, in parallel with the calculation processing of the accumulated values, the processing is performed to read the accumulated values stored in the accumulators ACC1, ACC2, ACC3, . . . , ACCn in the second accumulator group 334; however, for only the first single vertical scanning period, the accumulated values are worthless, and thus the description is omitted.

Then, when the processing for the rows 1 to m is executed, the determination result of the step S114 becomes affirmative, and thus the processing is returned to the step S101 again, and the processing for the rows 1 to m is executed again. However, in the next vertical scanning period, the signal Ctr reaches an L level, thereby replacing the first accumulator group 332 with the second accumulator group 334 that performs accumulation (step S102). Consequently, each accumulated value of the value Sub, which is the value that the difference between the image signal, DV, and the reference signal, Ref, is multiplied by the coefficient, k1, for each column for a single vertical scanning period is stored into one of the accumulators ACC1, ACC2, ACC3, . . . , ACCn in the second accumulator group 334.

At the same time, in parallel with the calculation processing of the accumulated values, the processing is performed to add the product of the accumulated value Aj by the accumulator ACCj which corresponds to the jth column of the first accumulator group 332 in one previous vertical scanning period and the coefficient k2 to the image signal DV (i, j). Specifically, when a description is provided disregarding the multiplication of the coefficients k1 and k2, the accumulated value of the difference between the image signals, DV (1, j), DV (2, j), DV (3, j), . . . , DV (m, j) in the previous single vertical scanning period and the reference signal, Ref is added to the image signal DV (i, j) which is supplied during a certain vertical scanning period.

The subsequent operations are the same as discussed above, and in a certain vertical scanning period, the value Sub which is the value that the difference between the image signal, DV, and the reference signal, Ref, is multiplied by the coefficient, k1, is accumulated for each column in each of the accumulators ACC1, ACC2, ACC3, . . . , ACCn in one of the first accumulator group 332 and the second accumulator group 334, whereas the accumulated value in the previous single vertical scanning period before the current vertical scanning period is read from each of the accumulators ACC1, ACC2, ACC3, . . . , ACCn and added to the image signal DV for the vertical scanning period in the other one of the first accumulator group 332 and the second accumulator group 334, and the above operations are performed interchangeably for each single vertical scanning period.

<3: Summary of Embodiment>

Figure 10:
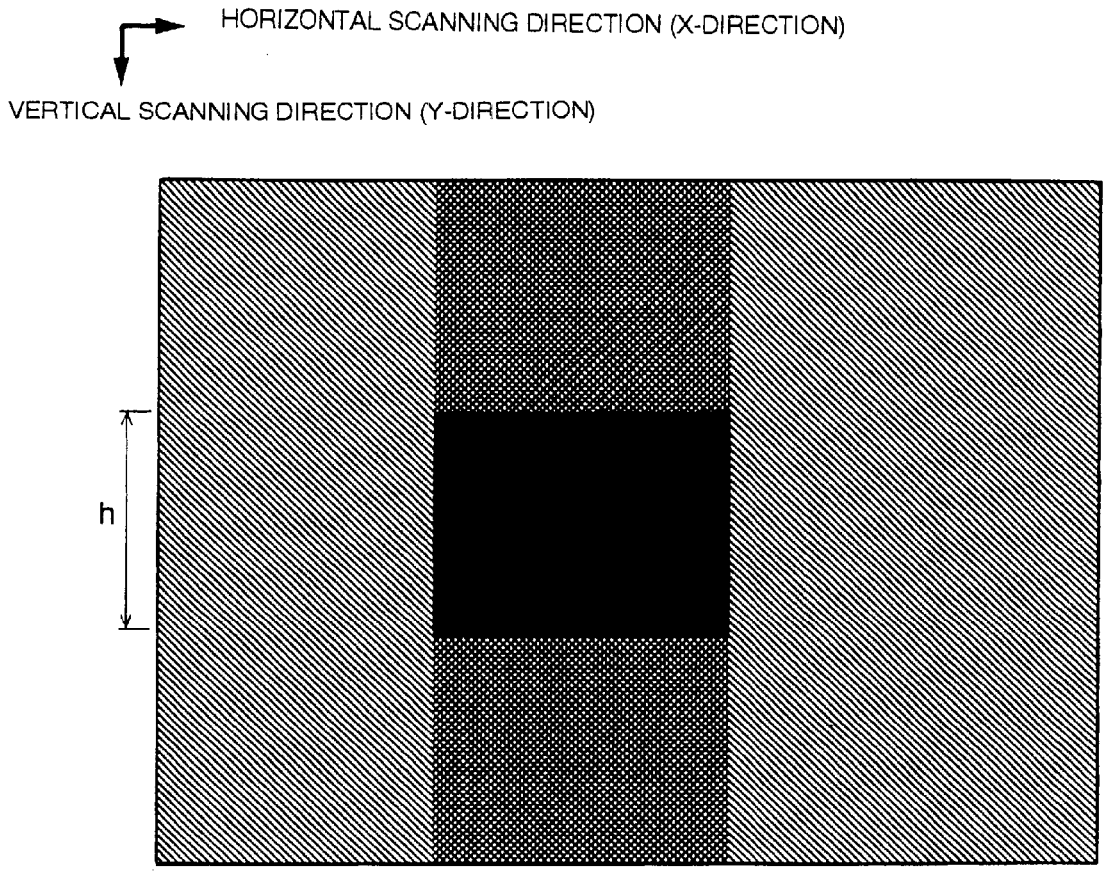
FIG. 10 is a diagram that illustrates deterioration of display quality by vertical cross-talk.

Now, in a liquid crystal display device according to the present embodiment, for example, when performing display as shown in FIG. 10, for the image signal of the gray pixels having no black area in the Y-direction, the difference between the density of the gray and the density specified by the reference signal, Ref, is small, and thus it is not corrected very much, whereas for the image signal of the gray pixels having black area in the Y-direction, it is corrected corresponding to both the difference between the density of the black color and the density specified by the reference signal, and the distance of the black area in the vertical direction, h. Consequently, when the image signal of the gray pixels in the column where black area exists in the Y-direction is corrected considering the black display area, the influence of the vertical cross-talk is reduced, minimized or removed, and as a result, the display density based on the corrected image signal is close to the original gray, thereby reducing, minimizing or preventing deterioration of display quality.

In this regard, in the present embodiment, the image signal of black pixels in the black area is also corrected. When considering the characteristic of an effective voltage applied to a liquid crystal capacitor and the transmittance ratio, as is well known, in the area where the transmittance ratio is low (black display) or high (white display), the transmittance ratio does not change very much with respect to the change of the effective voltage. As a result, even if the image signal corresponding to black pixels is corrected, the density is not changed very much, and thus it is hardly visualized by a user as deterioration of display quality.

Also, in the present embodiment, for an image signal during a certain vertical scanning period, the signal is corrected not based on the image signal of the same column in the vertical scanning period, but based on the image signal of the same column in the previous vertical scanning period. The influence of this is considered to be slight, because typically there are only small changes between the images being scanned in the adjacent vertical scanning period.

Alternatively, if the arrangement is adopted that for an image signal during a certain vertical scanning period, the image signal is corrected based on the image signal of the same column in the same vertical scanning period, it is necessary to hold the image signal for one vertical scanning period or more, thereby increasing the memory amount that is needed. As opposed to this, in the present embodiment, the difference between the image signal, DV, and the reference signal, Ref, is accumulated for each column for one vertical scanning period, and the accumulated value of the previous one vertical scanning period is output in the structure in which the first accumulator group 332 and the second accumulator group 334 are switched to each other for each one vertical scanning period, and thus the memory amount that is needed is not as much as one screen (m rows multiplied by n columns), and instead is kept as two rows (two rows multiplied by n columns). Consequently, it is possible to simplify the structure.

In this regard, in the above-described embodiment, the arrangement is provided such that the image signal VID is sampled on one data line 114 in sequence. However, the arrangement can be provided such that the image signal VID is partitioned into n systems and is output extended n times in the time axis (serial to parallel conversion), and at the same time, sampling is performed for each n numbers of the data line 114. In this arrangement, for switches 151 (refer to FIG. 9), the time to apply the image signal becomes longer, thereby making it possible to ensure enough sample & hold time and charge and discharge time. At the same time, in the above-described embodiment, although the image signal correction circuit 300 processes digital image signals, it can be arranged such that an analog image signal is processed.

Also, in the above-described embodiment, coefficients k1 and k2 are commonly used for each period. However, since vertical cross-talk has a tendency to occur depending on the writing polarity, the coefficients k1 and k2 can be different in a positive-polarity writing and negative-polarity writing. In an embodiment, it can be arranged that, for each single horizontal scanning period, different coefficients k1 and k2 are provided.

Also, in the above-described embodiment, although a description is provided based on the normally white mode in which white display is performed when the voltage applied to the liquid crystal capacitor 105 is zero, it may be based on the normally black mode in which black display is performed.

In addition, in the present embodiment, although TFT is used for a switching element, a silicon substrate can be used for the element substrate, and various elements can be created at the substrate. In this case, high-speed field effect transistors can be used, thereby making it easy to achieve high-speed operation. However, the substrate does not have transparency, and thus it is necessary to use as a reflection type.

Further, in the above-described embodiment, TN liquid crystal is used. However, bistable liquid crystal having memorization, such as BTN (Bi-stable Twisted Nematic) type and ferroelectric type, and polymer dispersed type, and the GH (guest-host) type liquid crystal in which dye molecules and crystal molecules are arranged in parallel by mixing the dye (guest) having anisotropy in absorption of visible light in the molecular longitudinal direction and latitudinal direction with liquid crystals (host) having a certain molecular arrangement can be used.

Also, the liquid crystal can be arranged by perpendicular alignment (homoetropic alignment) in which liquid crystal molecules are aligned perpendicularly to the substrates when no voltage is applied, whereas liquid crystal molecules are aligned horizontally to the substrates when voltage is applied, or it can be arranged by a parallel (horizontal) alignment (homogeneous alignment) in which liquid crystal molecules are aligned horizontally to the substrates when no voltage is applied, whereas liquid crystal molecules are aligned perpendicularly to the substrates when voltage is applied. In this way, in the present invention, various types of liquid crystal and alignment method can be applied.

<4: Electronic Devices>

Next, some of the electronic devices to which the electro-optic device according to the above-described embodiment is applied will be described.

<4-1: Projector>

Figure 6:
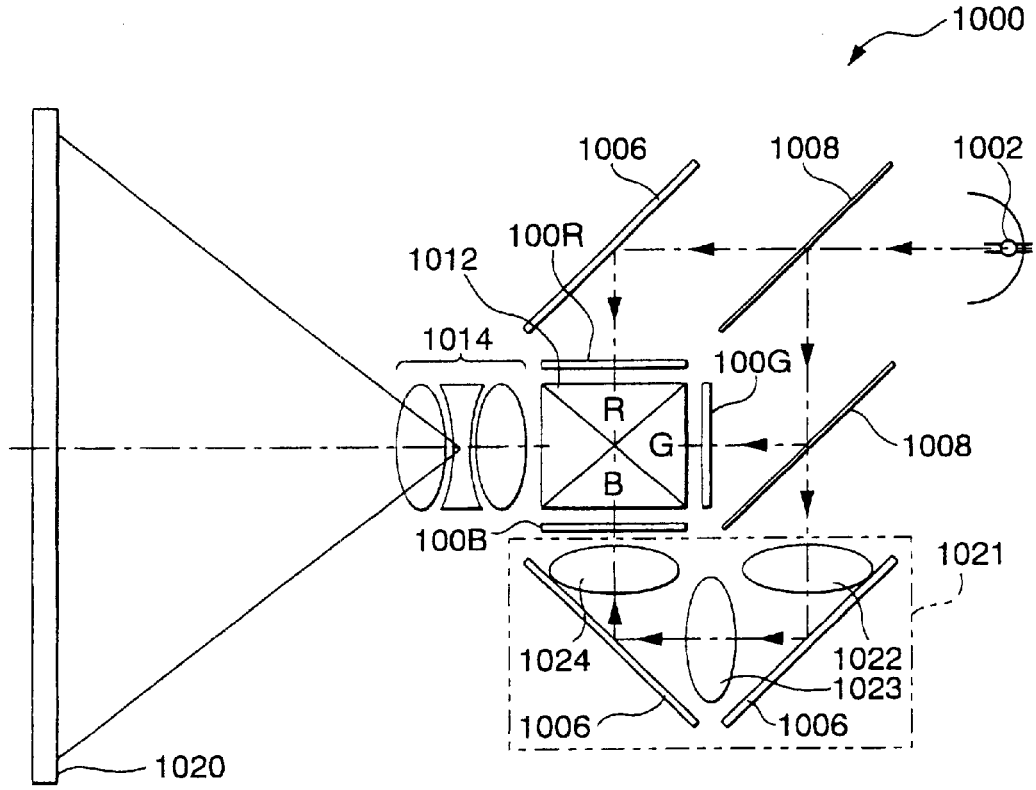
FIG. 6 is a schematic showing the structure of a projector, which is an example of an electronic device to which the liquid crystal display device is applied.

First, a projector using the above-described electro-optic device 10 as a light valve will be described. FIG. 6 is a schematic showing the structure of the projector.

As shown in FIG. 6, within the projector 1000, a lamp unit 1002 is equipped with a white light source such as a halogen lamp. The projection light emitted from the lamp unit 1002 is separated into three primary colors, R (red), G (Green), and B (Blue), by three mirrors 1006 and two dichroic mirrors 1008 disposed inside the projector, and guided to light valves 100R, 100G, and 100B each of which corresponds to each primary color.

The light valves 100R, 100G, and 100B are basically the same as the liquid crystal panel 100 of the electro-optic device 10 according to the above-described embodiment. Specifically, the light valves 100R, 100G, and 100B are driven by the image data, DV, each of which corresponds to an RGB color, and work as light modulators that generate individual RGB primary color images, respectively.

Furthermore, since the B light has a longer light path compared with the other light, R and G, the light is guided through a relay lens system 1021 which includes an incident lens 1022, a relay lens 1023, and an exit lens 1024 so as to prevent loss.

Now, each light modulated by one of the light valves 100R, 100G, and 100B enters into the dichroic prism 1012 from three directions. The R and B light is deflected 90 degrees via the dichroic prism 1012, while the G light goes straight through. As a result, a color image formed of each primary color image is projected onto a screen 1020 via a projection lens 1014.

In this regard, a dichroic mirror 1008 makes the light corresponding to each primary color RGB incident on the light valves 100R, 100G, and 100B, thereby making it unnecessary to arrange color filters as in the case of the direct viewing type. Also, the transmission images through the light valves 100R and 100B are reflected via the dichroic prism 1012, and are then projected, whereas the transmission image of G via the light valve 100G is projected directly. Thus, the transmission image of R via the light valve 100R and the transmission image of B via the light valve 100B are mirror-reversed with respect to the transmission image of G via the light valve 100G.

<4-2: Personal Computer>

Figure 7:
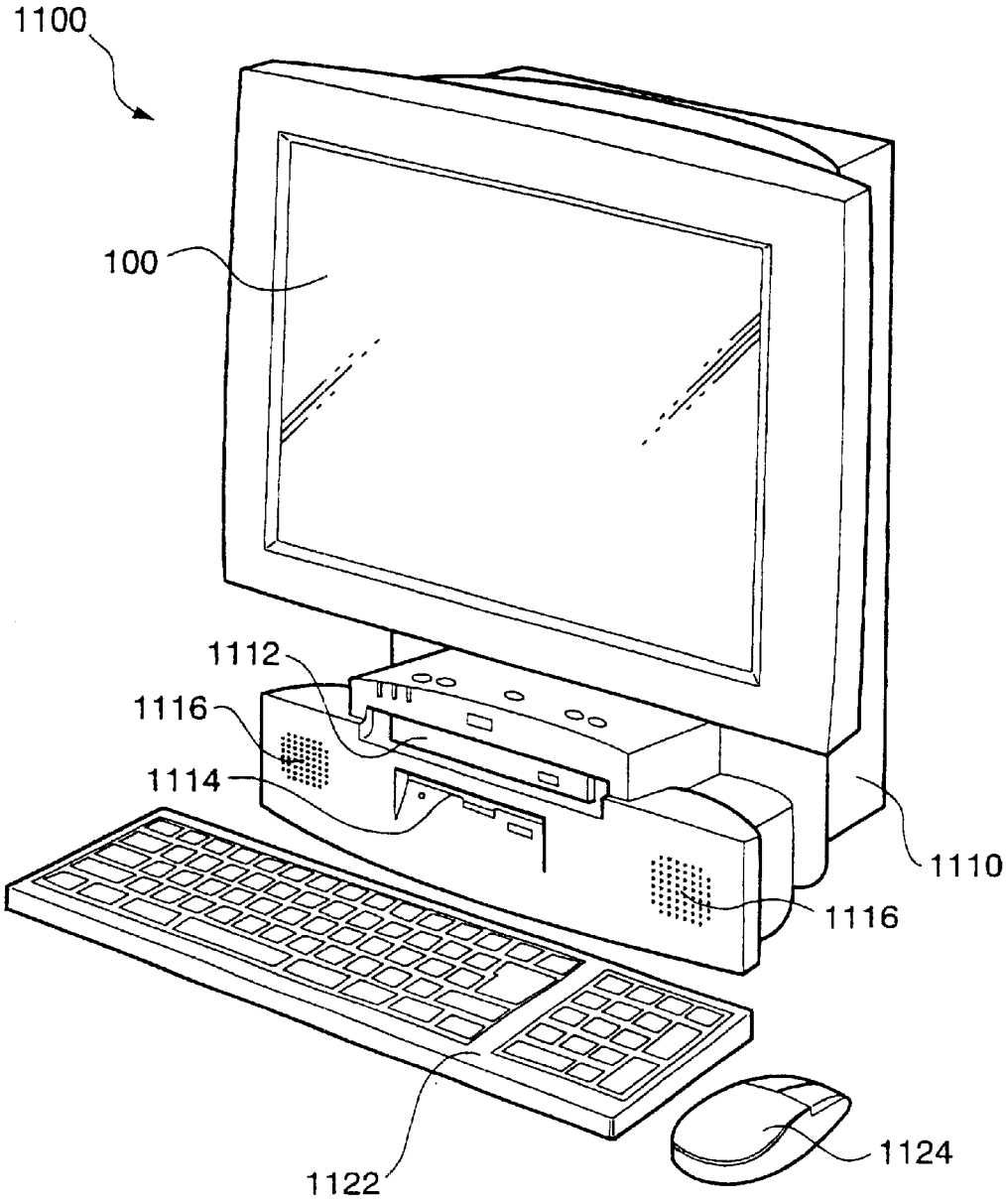
FIG. 7 is a perspective view showing the structure of a personal computer, which is an example of an electronic device to which the liquid crystal display device is applied.

Next, an example in which the above-described electro-optic device 10 is applied to a multimedia-enabled personal computer will be described. FIG. 7 is a perspective view showing the configuration of the personal computer.

As shown in FIG. 7, a main unit 1110 of a computer 1100 is equipped with a liquid crystal panel 100 used as a display unit, an optical disk read/write drive 1112, a magnetic disk read/write drive 1114, and stereo speakers 1116. Also, the system is configured such that a keyboard 1122 and pointing device (mouse) 1124 send and receive input/control signals to and from the main unit 1110 by wireless such as via infrared rays.

This liquid crystal panel 100 is used as a direct viewing type, and thus one dot is formed of three pixels, RGB, and a color filter is arranged corresponding to each pixel in the liquid crystal panel 100.

Also, at the back of liquid crystal panel 100, a backlight unit (not shown in FIG. 7) is provided in order to ensure visibility in dark places.

<4-3: Mobile Phone>

Figure 8:
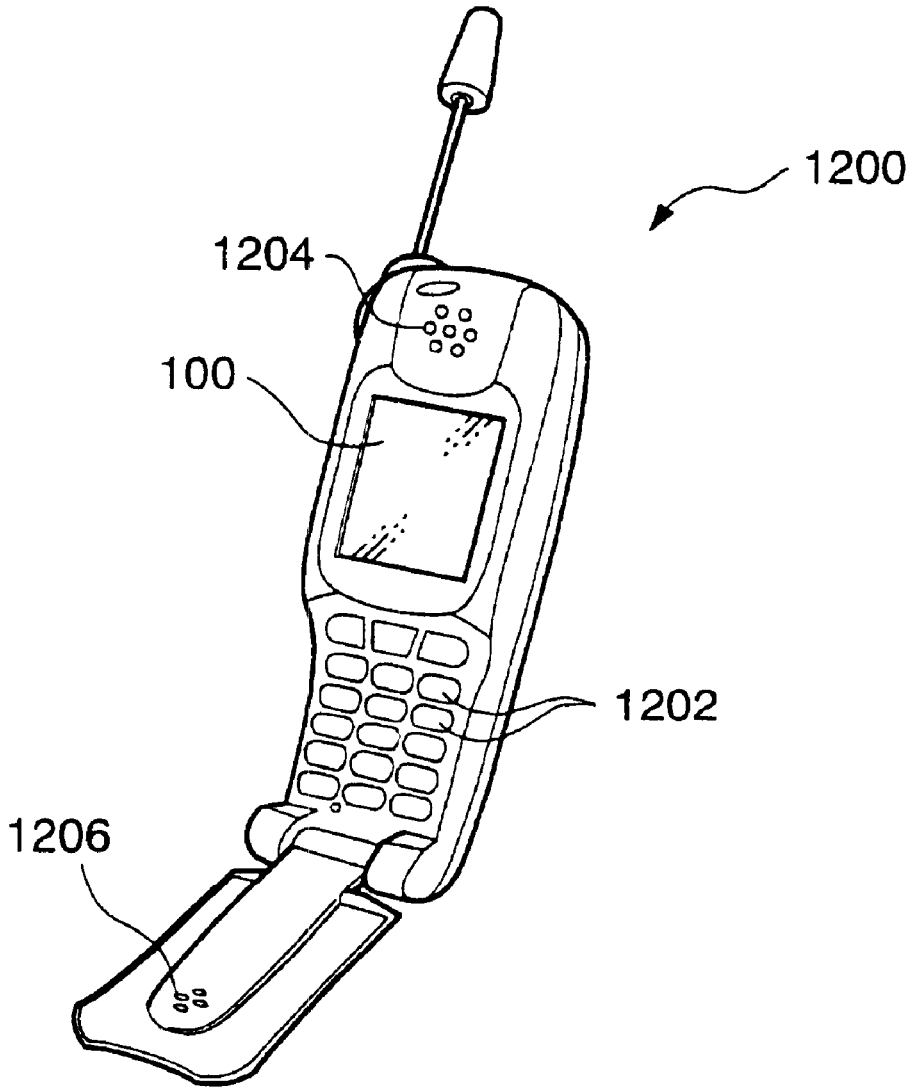
FIG. 8 is a perspective view showing the structure of a mobile phone, which is an example of an electronic device to which the liquid crystal display device is applied.

Furthermore, an example in which the above-described liquid crystal panel 100 is applied to a display unit of a mobile phone will be described. FIG. 8 is a perspective view showing the structure of the mobile phone. In FIG. 8, a mobile phone 1200 includes a plurality of operator buttons 1202, a receiver 1204, a mouthpiece 1206, and the above-described liquid crystal panel 100 of the electro-optic device 10. In this regard, on the back of the liquid crystal panel 100, a backlight unit (not shown) is arranged so as to ensure visibility in the dark, similarly to the above-described personal computer.

<4-4: Summary of Electronic Devices>

Electronic devices other than those described with reference to FIGS. 6, 7, and 8, can also be used with the invention. These electronic devices include, but are not limited to: flat-screen TVs, view finder-type/monitor-directly-view-type video tape recorders, car navigation systems, pagers, electronic diaries, calculators, word processors, workstations, TV telephones, POS terminals, digital still camera, devices with touch panels, and so on. The electro-optic device according to an embodiment and its variations can be applied to these and other various electronic devices.

As described above, the present invention can reduce, minimize or prevent an occurrence of vertical cross-talk without using pre-charge, thus allowing display in high quality.

What is claimed is:

1. An image signal correction method that corrects an image signal which has information corresponding to a transmittance ratio of a pixel arranged in a matrix extended in a row direction and a column direction, and is supplied in synchronization with horizontal scanning in said row direction and vertical scanning in said column direction, the correction method comprising:

calculating a difference between said image signal and a reference signal that has information corresponding to a reference transmittance ratio;

storing an accumulated value of the difference for each column for one vertical scanning period; and adding a value corresponding to the accumulated value to the image signal of the pixel of the column corresponding to the accumulated value for correction.

2. An image signal correction circuit that corrects an image signal which has information corresponding to a transmittance ratio of a pixel arranged in a matrix extended in a row direction and a column direction, and is supplied in synchronization with horizontal scanning in said row direction and vertical scanning in said column direction, the correction circuit comprising:

a subtracter which calculates a difference between said image signal and a reference signal that has information corresponding to a reference transmittance ratio;

an accumulator which accumulates and stores a value of the difference for each column for one vertical scanning period; and an adder which adds a value corresponding to the accumulated value which is derived by the accumulator to the image signal of the pixel of the column corresponding to the accumulated value for correction.

3. The image signal correction circuit according to claim 2, the accumulator including;

an accumulator selection part which is provided corresponding to pixels of two rows and selects, from the accumulators corresponding to one of the rows, an accumulator in the column of the pixel specified by the image signal, and accumulates the difference, and which selects, from the accumulators corresponding to the other row, an accumulator in the column of the pixel specified by the image signal, and reads the accumulated value; and a switching part which switches the accumulators belonging to one row and the accumulators belonging to the other row for every single vertical scanning period.

4. The image signal correction circuit according to claim 2, said reference signal having information of a transmittance ratio corresponding to a gray display.

5. The image signal correction circuit according to claim 2, the image signal for one vertical scanning period which is accumulated in said accumulator being the image signal of the one immediately prior vertical scanning period with reference to the image signal of the one vertical scanning period to be corrected.

6. The image signal correction circuit according to claim 2, the difference by said subtracter or the value corresponding to said accumulated value being multiplied by a coefficient.

7. The image signal correction circuit according to claim 6, said coefficient having a different value in the case of a positive-polarity writing and in the case of a negative-polarity writing.

8. A liquid crystal display device, comprising:

a subtracter which calculates a difference between the image signal that has information corresponding to a transmitter ratio of a pixel arranged in a matrix extended in a row direction and a column direction and is supplied in synchronization with horizontal scanning in said row direction and vertical scanning in said column direction, and a reference signal that has information corresponding to a reference transmittance ratio;

an accumulator which accumulates and stores a value of the difference for each column for one vertical scanning period;

an adder which adds a value corresponding to the accumulated value to the image signal of the pixel of the column corresponding to the accumulated value; and a liquid crystal capacitor to which the voltage signal based on the signal output from said adder is applied corresponding to said horizontal scanning and vertical scanning.

9. An electronic device, comprising:

a display part including a liquid crystal display device, said liquid crystal display device including:

a subtracter which calculates a difference between an image signal that has information corresponding to a transmittance ratio of a pixel arranged in a matrix extended in a row direction and a column direction and is supplied in synchronization with horizontal scanning in said row direction and vertical scanning in said column direction, and a reference signal that has information corresponding to a reference transmittance ratio;

an accumulator which accumulates and stores a value of the difference for each column for one vertical scanning period;

an adder which adds a value corresponding to the accumulated value to the image signal of the pixel of the column corresponding to the accumulated value; and a liquid crystal capacitor to which the voltage signal based on the signal output from said adder is applied corresponding to said horizontal scanning and vertical scanning.

* * * * *